US006631749B1

(12) United States Patent
Zabala

(10) Patent No.: US 6,631,749 B1
(45) Date of Patent: Oct. 14, 2003

(54) WIND RESISTANT ROLLING SHUTTER ASSEMBLY

(76) Inventor: Jaime Zabala, 5901 Bermuda La., Naples, FL (US) 34119

( * ) Notice: Subject to any disclaimer, the term of this patent is extended or adjusted under 35 U.S.C. 154(b) by 15 days.

(21) Appl. No.: 10/152,027

(22) Filed: May 22, 2002

(51) Int. Cl.[7] ..... E06B 9/08
(52) U.S. Cl. ..... 160/133; 160/235; 160/236
(58) Field of Search ..... 160/133, 231.1, 160/229.1, 201, 232, 235, 236, 273.1

(56) References Cited

U.S. PATENT DOCUMENTS 4,234,033 A * 11/1980 Leivenzon et al. ..... 160/133
5,253,694 A 10/1993 Bernardo
5,318,090 A * 6/1994 Chen ..... 160/171
5,549,149 A * 8/1996 Sills et al. ..... 160/201
5,657,805 A 8/1997 Magro
5,839,493 A 11/1998 Quasius
6,095,224 A * 8/2000 Miller ..... 160/133
6,095,225 A * 8/2000 Miller ..... 160/133

FOREIGN PATENT DOCUMENTS

DE 4006212 * 8/1991 ..... 160/133 X

* cited by examiner

*Primary Examiner*—Bruce A. Lev
(74) *Attorney, Agent, or Firm*—Richard C. Litman

(57) ABSTRACT

A wind resistant rolling shutter assembly having a flexible barrier made of a plurality of interconnected slats. Each individual slat is hollow, has inner and outer surfaces, two opposing ends and one or more support ribs. Two brackets each having two opposing ends, run internally from one opposing end of each slat to the other. Four slat end retainers, each having a head and a point, are disposed point first one in each bracket end. The flexible barrier rides in two track assemblies positioned vertically on the frame of a door or window. The track assemblies have track channels and retention arms located therein. When the slats are flexed the slat retainers interact with retention arms and prevent the dislodgement of the flexible barrier.

4 Claims, 4 Drawing Sheets

WIND RESISTANT ROLLING SHUTTER ASSEMBLY

BACKGROUND OF THE INVENTION

1. Field of the Invention

The present invention relates to hurricane shutters, in particular to a wind resistant rolling shutter assembly.

2. Description of the Related Art

Every year hurricanes form over warm tropical waters around the world and many make landfall causing great destruction to real estate, especially coastal homes. For this reason many jurisdictions require hurricane shutters for all new homes built near the coast. Hurricane shutters function to prevent flying objects and/or wind from penetrating doors and windows and thereby prevent much of the damage associated with hurricanes.

The first hurricane shutters were simply plywood planks nailed into position over doors and windows. Plywood shutters are relatively inexpensive but they are heavy, unwieldy, and time consuming to install.

Rolling shutters offer solutions to many of the drawbacks inherent in plywood shutters. They can be opened or closed in a matter of seconds using a hand crank or electric motor. Rolling shutters have a number of interconnected slats that may be rolled or unrolled from a rod. The slats run down a set of tracks fastened to the frame of a window or door. The slats themselves are ordinarily aluminum or PVC, both of which are lightweight, somewhat flexible materials. Lightweight slats are easier to use and flexible slats can better absorb impacts from windblown debris. This flexibility can have its drawbacks however. High winds, extreme low pressure, and impacts can cause the slats to flex so much that the slats are actually ripped from their tracks. Several inventions have been devised to address this problem, including the following.

U.S. Pat. No. 5,253,694 to Bernado teaches an improvement in rolling shutters that includes a slat end fin attached to the ends of individual shutter slats. The fin is contoured and configured for securing a slat end to the side track. Each fin is fastened to the slat end with several rivets. The '694 invention differs from the present invention in that the present invention does not require specialized fins nor any rivets which could weaken the slat ends.

U.S. Pat. No. 5,657,805 to Magro discloses a wind resistant overhead closure that includes substantially vertical windbars mounted on the side portions of the door frame, and windlocks or endlocks on the lateral edge portions of the intermediate and bottom most slats of the closure. The '805 invention can be distinguished from the present invention in that the windlocks of the '805 must be engaged manually and do not provide security for every slat.

U.S. Pat. No. 5,839,493 to Quaisius discloses a shutter system for a portal opening having a flexible barrier made of a plurality of interlocking flexible barrier slats having stop elements attached to barrier slate ends, a mounting assembly having guide tracks disposed on each side of the portal opening, and a retention assembly. The '493 invention is distinguishable from the present invention in that the present invention lacks the reinforcement bar which secures the retention assemblies. The present invention also has multiple retention devices of differing sizes rather than a single retention device per slat end.

None of the above inventions and patents, taken either singularly or in combination, is seen to describe the instant invention as claimed. Thus a wind resistant rolling shutter assembly solving the aforementioned problems is desired.

SUMMARY OF THE INVENTION

The present invention relates to a shutter for a portal opening such as a window or a door and is suitable for protecting such window or door from hurricane force winds and airborne debris. The invention has a plurality of interconnected slats forming a flexible barrier having a front surface, a back surface and two opposing ends. Each slat is hollow and has one or more transverse ribs located internally for added rigidity. Each slat also has two sets of internal brackets that run from one opposing end to the other. Two slat retainers, disposed one in each end of each bracket, extend from each opposing end of each slat.

The flexible barrier is selectively moveable between an extended and retracted position. When in the retracted position the flexible barrier is preferably rolled around a rod disposed inside a housing located at the top of the door or window. When in the extended position the flexible barrier runs from the rod, out of the housing, down two track assemblies positioned on either side of the door or window frame, to the bottom of the frame.

Each track assembly has a flat front and back wall, a side wall, an internal support wall and two opposing ends. A channel bounded by the front, back and support walls runs from one opposing end of the track to the other. Two retention arms are located inside the channel and run from opposing end to opposing end. When in use, the flexible barrier is positioned with each opposing end of its interconnected slats being positioned in the channels of the track assembly. Forces acting against the slats will cause the slats to flex. Flexion of the slats will cause the slat retainers to contact the retention arms which will prevent the slats from flexing further thus reducing the possibility of slats being forced from the track assembly.

Accordingly, it is a principal object of the invention to provide a system for preventing the removal of interconnected slats from a track assembly through the use of selectively engageable slat retainers.

It is another object of the invention to provide a wind resistant rolling shutter that has a minimum of parts.

It is a further object of the invention to provide a wind resistant rolling shutter that requires a minimum amount of labor to assemble and install.

It is still a further object of the invention to provide a wind resistant rolling shutter that is light weight.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
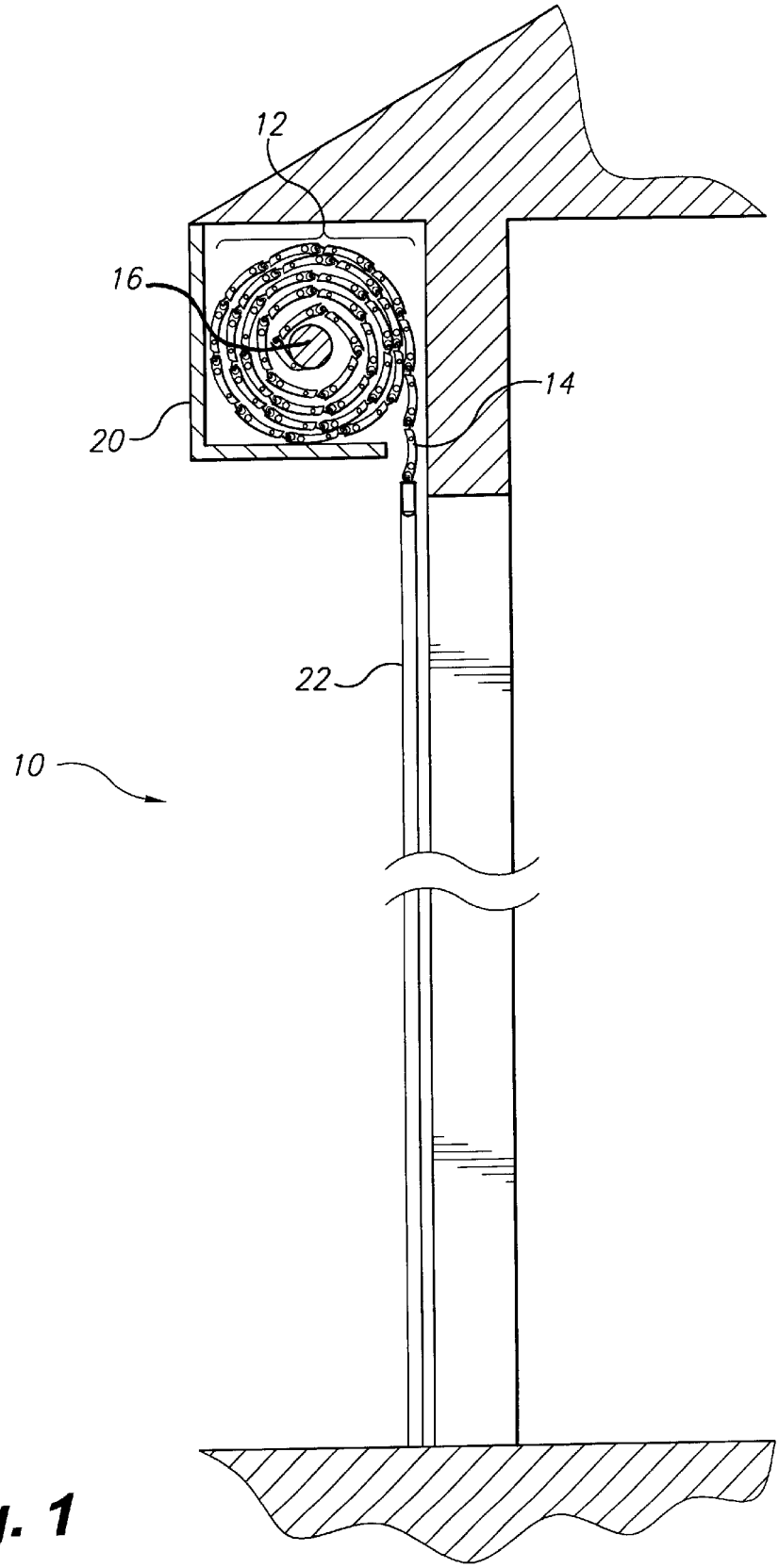
FIG. 1 is an environmental, sectional view of a wind resistant rolling shutter assembly according to the present invention in a retracted position.

The present invention, a wind resistant rolling shutter, is used primarily to protect doors and windows from high winds and windblown debris associated with tropical storms and hurricanes. FIG. 1 shows the wind resistant rolling shutter 10 as it is stored when not in use. The shutter 10 forms a flexible barrier 12 made of interconnected slats 14. When in the retracted position, as shown, the barrier 12 is rolled around a rod 16 inside a housing 20. The flexible barrier 12 travels in a track assembly 22 (discussed below).

Figure 2:
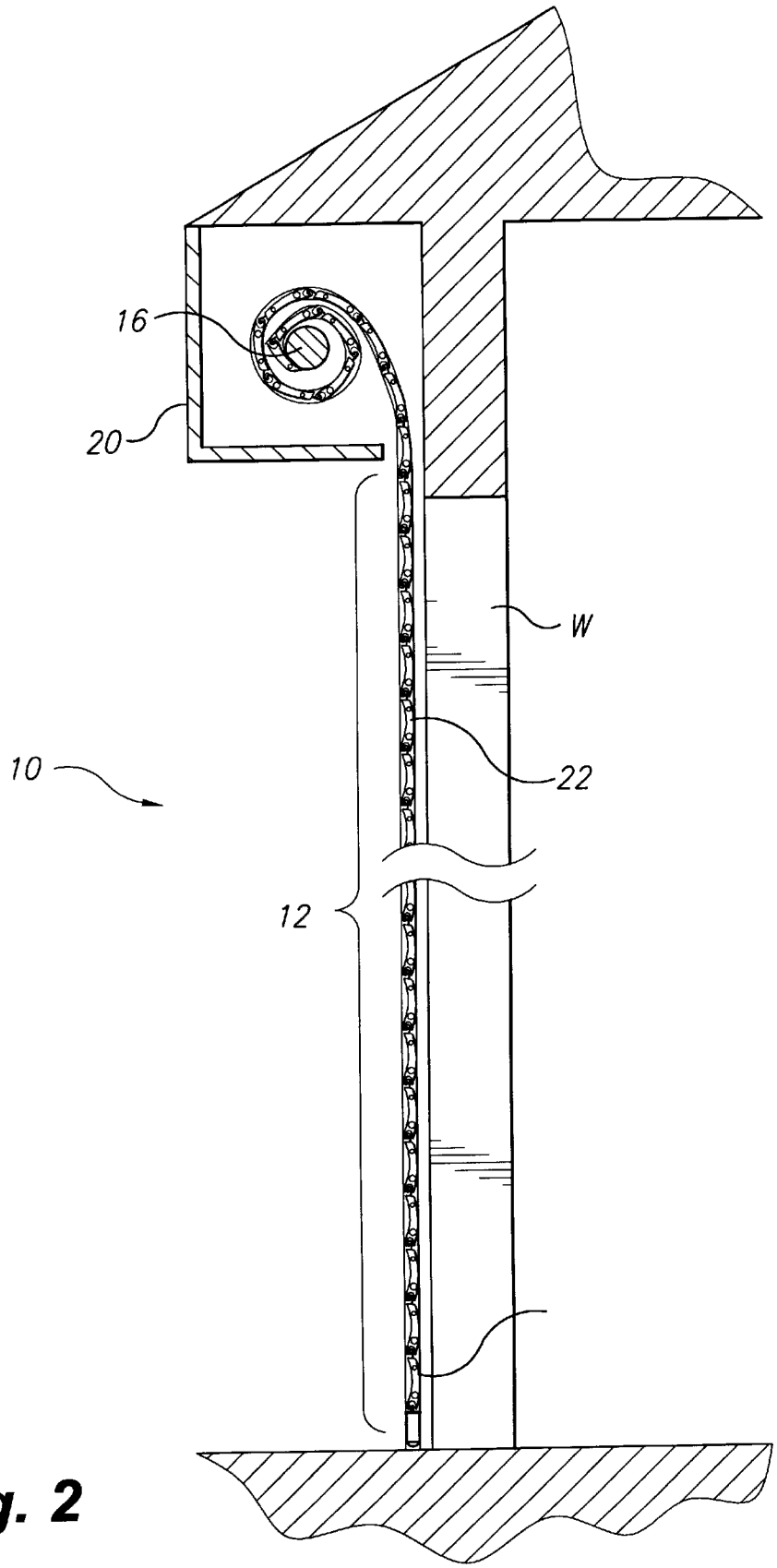
FIG. 2 is an environmental, sectional view of a wind resistant rolling shutter assembly in the extended position, according to the present invention.

FIG. 2 shows the present invention in its extended position. The flexible barrier 12 has been unrolled from the rod 16 and moved down the track assembly 22 such that the flexible barrier 12 covers and protects the window W from flying debris and wind.

Figure 3:
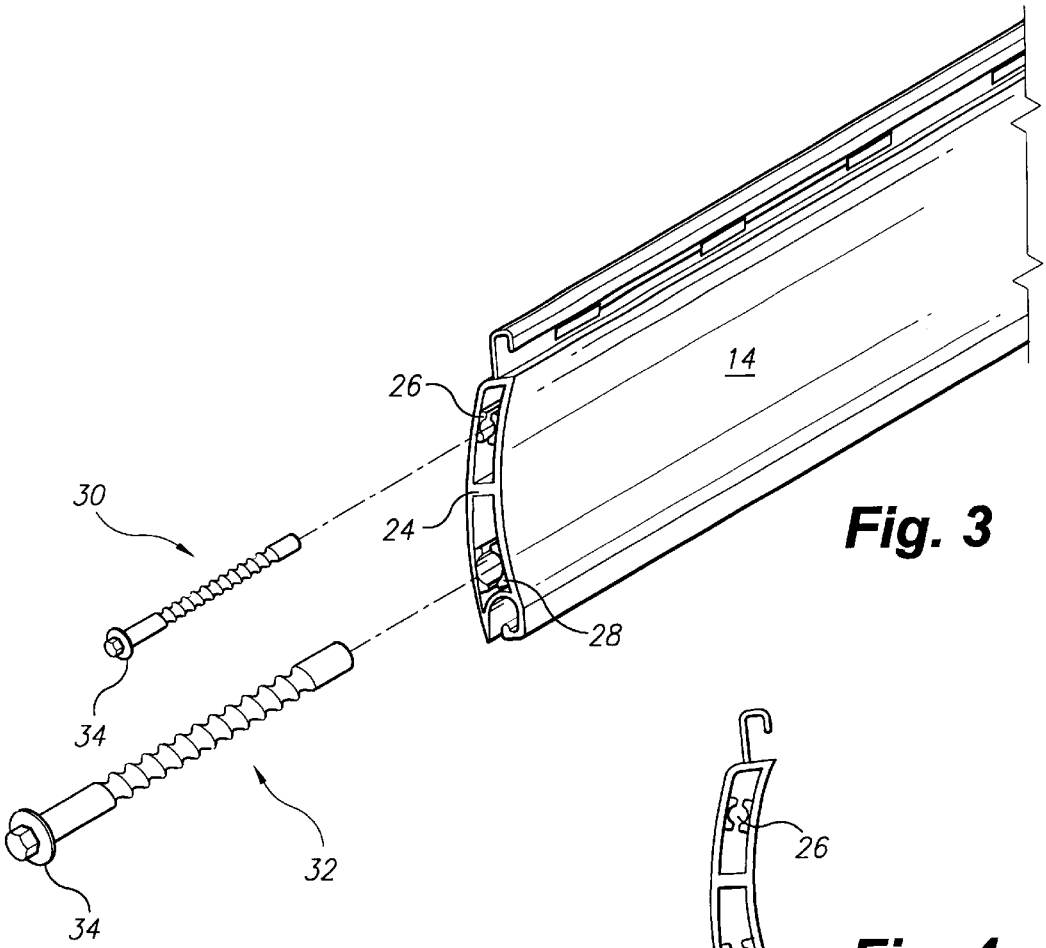
FIG. 3 is a perspective view of a slat and two slat retainers.

FIG. 3 illustrates a single slat 14 and two slat retainers 30, 32. Each slat 14 is elongated and hollow, with a front surface, a back surface, two opposing sides and two attachment edges. Each slat 14 is preferably made of extruded aluminum, is hollow and has at least one support rib 24 which provides additional structural rigidity. Two pairs of integrated brackets 26, 28 are also located internally, adjacent and parallel to the attachment edges. The brackets 26, 28 each define a cylindrical internal space adapted to secure the slat retainers (discussed below). The brackets 26, 28 are ordinarily produced when each slat is extruded as an integral part thereof. The integration of the brackets 26, 28 into the slat 14 during manufacture results in a reduction of time and labor costs during assembly.

Two slat retainers 30, 32, are adapted to be securely inserted into the integrated brackets 26, 28. The slat retainers 30, 32 preferably have a head which is surrounded by a flaired nylon collar 34, an externally threaded central portion, and a tip. The brackets 26, 28 preferably define an internally threaded receptacle for receiving the threaded portion of the slat retainers 30, 32. The mating threads ensure a secure connection when the retainers 30, 32 are rotatably inserted into the brackets 26, 28.

Figure 4:
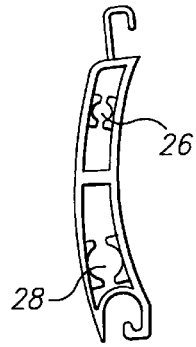
FIG. 4 is a side view of a slat.

FIG. 4 shows a side view of a slat 14 of the present invention. The brackets 26, 28 as shown differ in size and therefore define differing internal spaces. This difference in the size of the threaded receptacles allows for the use of slat retainers 30, 32 of different diameters and/or lengths. The ability to use retainers 30, 32 of different sizes allows the shutter assembly to be optimized for the strength to weight and/or cost ratio of a particular rolling shutter 10 for a particular geographical area. It is, however, also possible to use a slat 14 with brackets 26, 28 that are the same size within the compass of the present invention.

Figure 5:
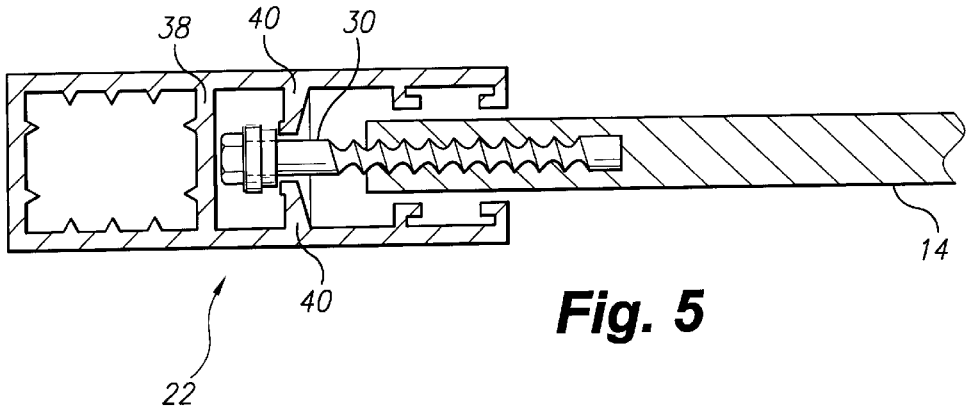
FIG. 5 is a cut-away side view of a slat and track assembly.

FIG. 5 illustrates the interaction of a slat 14, track assembly 22 and a slat retainer 30. Each track assembly 22 has a flat front and back wall, a side wall, an internal support wall 38 and two opposing ends. A channel bounded by the front, back and support 38 walls runs from one opposing end of the track to the other. Two retention arms 40 are located inside the channel and run from one opposing end to the other. The retention arms 40 extend at right angles from the side walls of the track assembly 22 and come to a point that extends slightly toward the support wall 38. When in use, the interconnected slats 14 making up the flexible barrier 12 are positioned inside the channel. The slat retainers 30 extend from the end of each slat 14 to a position adjacent to the internal support wall 38.

Figure 6:
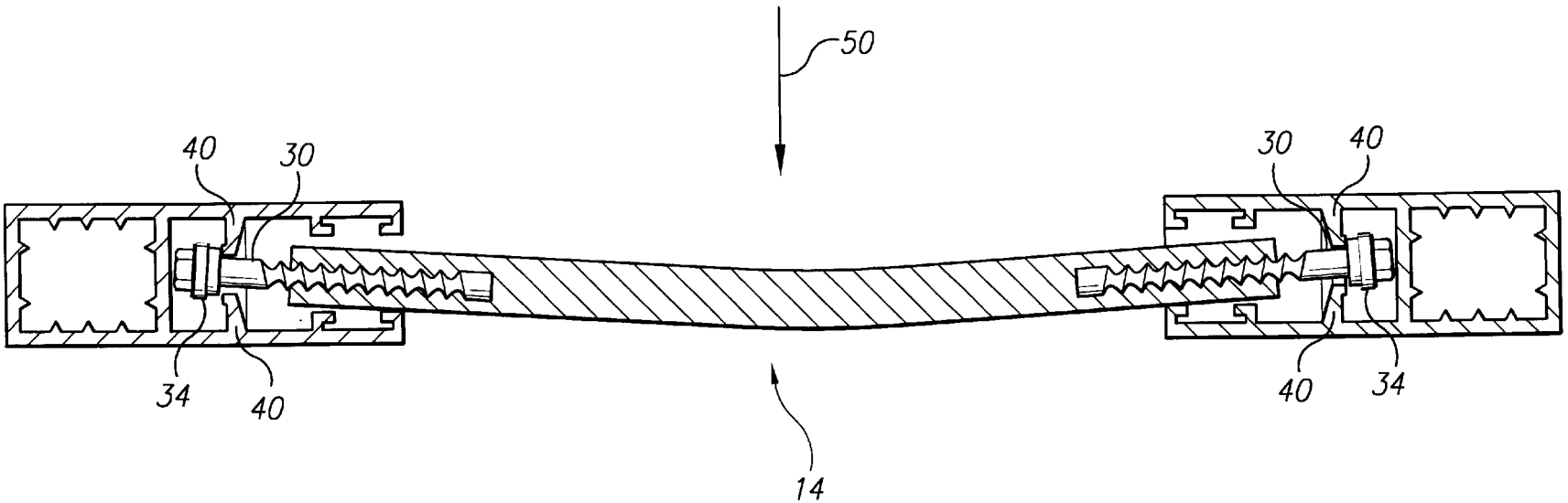
FIG. 6 is a cut-away side view of a slat being flexed and thereby engaging slat end retainers.

As seen in FIG. 6 a force 50 is acting against the slat 14 causing it to flex. This causes the slat retainers 30, 32 (32 not shown) to contact the retention arms 40 which will prevent the slats from further flexing and possibly being removed from the track assembly 22. Force directed in the opposite direction will have a similar result causing the slat retainers 30, 32 to engage the opposing retention arms 40. The nylon collar 34 enlarges the contact area and prevents damage to the slat retainers 30, 32 and retention arms.

It is to be understood that the present invention is not limited to the embodiments described above, but encompasses any and all embodiments within the scope of the following claims.

I claim:

1. A wind resistant rolling shutter assembly for a portal opening, comprising:

a plurality of interconnectable slats, each of said slats being hollow and having an inside surface, an outside surface, two connection edges, a first end and a second opposing end, wherein said plurality of interconnected slats form a flexible barrier when in an extended position for covering the portal opening, said flexible barrier having inner and outer surfaces, a top end, a bottom end and two opposing sides;

at least one support rib integrally formed along the inside surface of each of said slats, said at least one rib extending from the first end to the second opposing end of each of said slats;

a first pair of brackets and a second pair of brackets, each said pair of brackets being integrally formed along the inside surface of each of said slats proximate a respective one of the connection edges and extending from the first end to the second opposing end of each of said slats, each said pair of brackets defining an internally threaded receptacle integrally formed at and extending from the first end and the second opposing end of each of said slats;

a plurality of retainers, each retainer of said plurality of retainers having a head and an externally threaded elongated member, wherein said each retainer is securely inserted into each said pair of brackets of each of said slats such that the externally threaded member of said each retainer is disposed within the internally threaded receptacle of each said pair of brackets with the head of said each retainer protruding from the first end and the second opposing end of each of said slats;

a first track assembly and a second track assembly mountable on opposite sides of the portal opening, each said track assembly having a length and defining a channel extending along the length thereof, wherein said channel receives the head of each said retainer for selectively moving said plurality of interconnectable slats between the extended position and a retracted position.

2. The wind resistant rolling shutter assembly according to claim 1, further comprising a rotatable rod attached to the top end of said flexible barrier; and a housing disposed around said rod and mountable above the portal opening.

3. The wind resistant rolling shutter assembly according to claim 1, further comprising a nylon collar disposed around the head of each said retainer.

4. The wind resistant rolling shutter assembly according to claim 1, wherein each of said slats is made of extruded aluminum.

* * * * *